United States Patent [19]

Roccaforte

[11] 4,138,016

[45] Feb. 6, 1979

[54] SLIDE TOP DISPENSER CARTON

[75] Inventor: Harry I. Roccaforte, Western Springs, Ill.

[73] Assignee: Champion International Corporation, Stamford, Conn.

[21] Appl. No.: 900,519

[22] Filed: Apr. 27, 1978

[51] Int. Cl.[2] ..... B65D 5/72; B65D 5/70

[52] U.S. Cl. ..... 206/620; 229/17 SC

[58] Field of Search ..... 229/17 SC, 7 SC; 206/611, 620

[56] References Cited

U.S. PATENT DOCUMENTS

| | | | |
|---|---|---|---|
| 1,951,274 | 3/1934 | Denman | 229/17 SC |
| 2,093,143 | 9/1937 | Bonner | 229/17 SC |
| 3,819,093 | 6/1974 | Forbes, Jr. | 229/17 SC |

FOREIGN PATENT DOCUMENTS

| | | | |
|---|---|---|---|
| 921524 | 3/1963 | United Kingdom | 229/17 SC |

*Primary Examiner*—Stephen P. Garbe
*Attorney, Agent, or Firm*—Evelyn M. Sommer

[57] ABSTRACT

A dispenser carton having a slidable closure formed by an extension panel hingedly connected to a side wall of the carton. This side wall is of a two-ply construction wherein the slidable closure panel is connected to the outermost ply. The innermost ply also has an extension panel which seats on an opposite extension panel of an opposite side wall to form a base support for the slidable panel. A top closure wall flap connected to the front and rear walls of the carton, respectively, is folded over the side extrusion panels and secured together to close the carton. The innermost extension panel of the two-ply side wall includes an opening therethrough, which is placed in registration with openings formed in the top closure wall flaps when the slidable closure panel is moved laterally with respect to the top wall flaps and innermost extension panel, enabling the contents of the carton to be dispensed therethrough.

4 Claims, 11 Drawing Figures

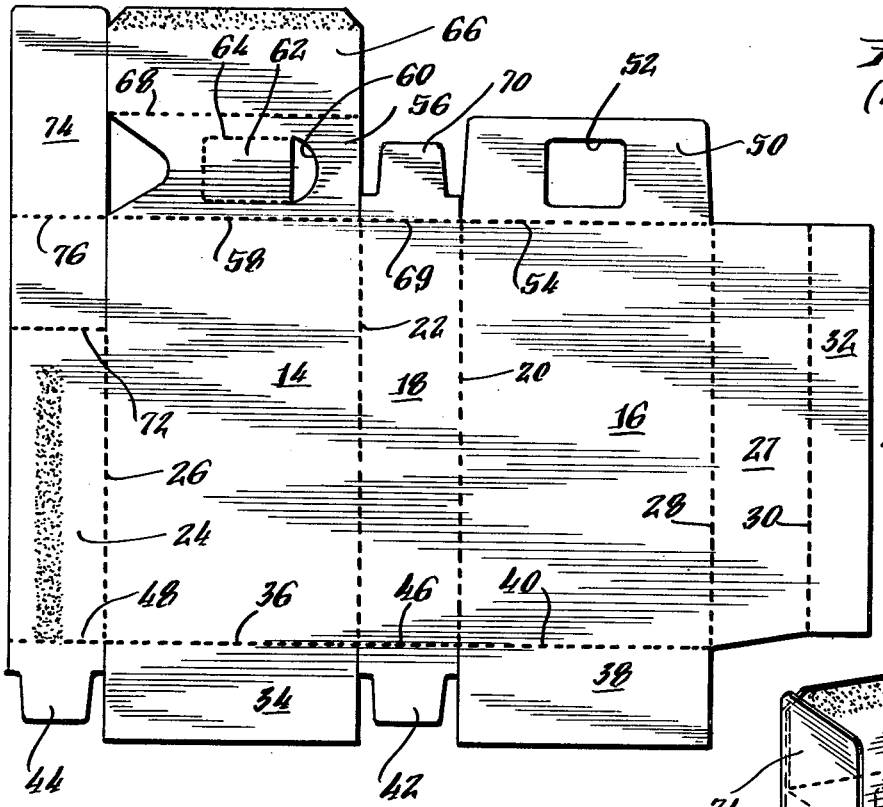
Fig. 1.
(PRIOR ART)
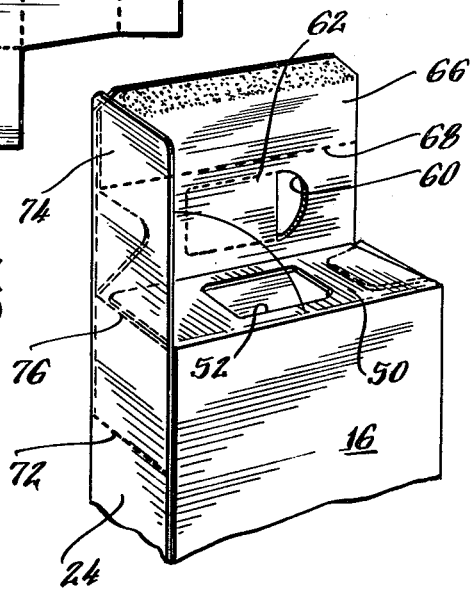
Fig. 3.
(PRIOR ART)
Fig. 2.
(PRIOR ART)
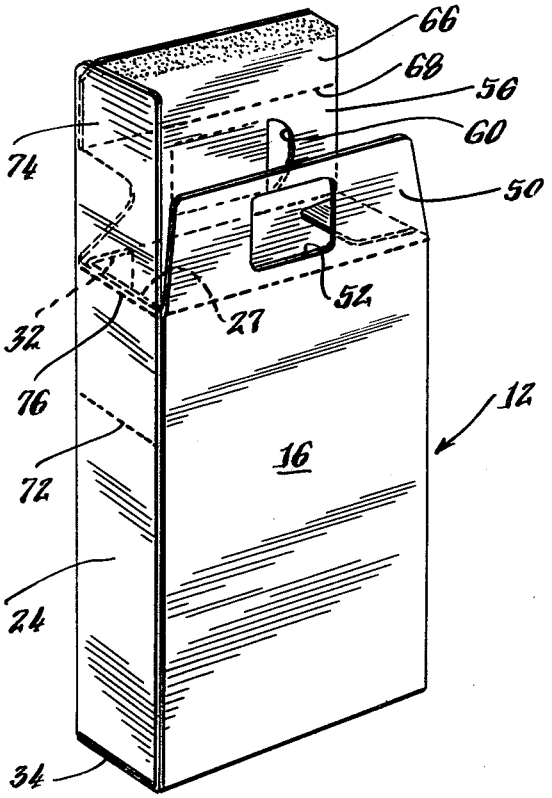
Fig. 4.
(PRIOR ART)
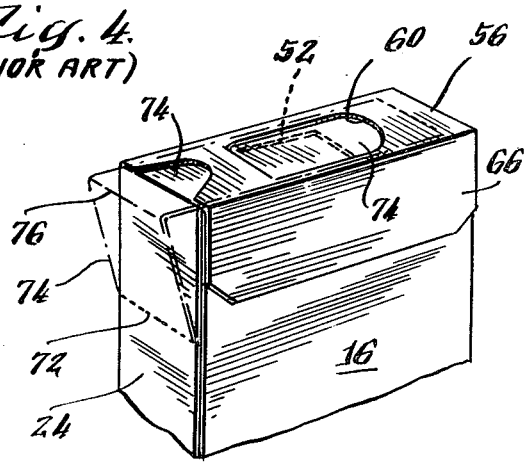

SLIDE TOP DISPENSER CARTON

BACKGROUND OF THE INVENTION

1. Field of the Invention

This invention relates to a carton for conveniently dispensing small confections or like articles and more particularly, to a carton having a top wall provided with a sliding closure which can be opened by the user to dispense small articles one at a time therethrough.

2. Description of the Prior Art

Cartons having a slide top closure are known in the art. For example, in my copending application Ser. No. 790,573, filed Apr. 25, 1977, now U.S. Pat. No. 4,094,456, a carton made from a single blank is disclosed which includes a slidable closure panel disposed between overlapping flaps which form the top wall of the carton. Aligned openings are provided in the top wall closure flaps which are separated and closed by the slide closure panel. By sliding the panel laterally with respect to the overlapping top flaps, the aligned openings in the closure flaps are brought into registration so as to enable the carton user to dispense one or more articles from the interior of the carton through the openings.

While the slidable closure of the prior art carton operates satisfactorily, the formation of such a carton from a single blank requires an adjustment in standard folding equipment to modify the folding sequence of the top wall flaps.

Normally, the top closure of single blank cartons are formed by first folding side flaps connected to the sides of the carton blank over each other and then forming the top closure by folding the front and back top wall closure flaps over the side flaps and adhesively connecting each of the top wall closure flaps to the other.

In the prior art carton, one of the side flaps forms the slide closure. For the slide closure to operate properly, the slide side flap must rest on a flap under it for support or else it will fall into the interior of the carton and thereby be rendered ineffective to reclose a dispensing opening in the top wall closure when the slidable flap is slid laterally relative thereto. Accordingly, to form the prior art carton, the normal folding sequence of the flaps must be modified, and the equipment for folding the flaps adjusted accordingly, so that the slide closure panel is disposed on top of one of the front and back top closure flaps and then the other of the front and back top closure flaps folded thereover so that the sliding closure is disposed between the top closure flaps. The sliding closure panel can then rest on the top of the front and back top closure flaps. When the slidable closure panel is slid laterally, aligned openings in the front and back top closure flaps will be placed in registration so as to be in a position to dispense a portion of the contents from the carton through the registered openings.

Furthermore, since the side slide closure panel must be positioned between the front and back top closure flaps, the top closure flaps cannot be adhesively joined to each other because of the slide closure disposed therebetween. This necessitates that an extension panel be connected to the free edge of one of the front and back top closure flaps to be glued to the front or back of the carton to provide the top wall closure.

The slide top dispenser carton of the present invention solves these problems and enables the carton to be folded on conventional equipment wherein the folding sequence of the flaps need not be modified nor the equipment adjusted accordingly. Further, the extension panel to complete the top wall closure is eliminated. Because the design of the present invention enables the top wall closure flaps to be folded in conventional sequence, the blank from which the carton is formed can also be made to nest in two directions on the paperboard from which it is cut to take additional advantage of economical use of the paperboard.

SUMMARY OF THE INVENTION

In accordance with the present invention, the top closure of the carton is provided with side flaps connected to the side walls of the carton which overlap to form a base or support for an additional side flap which forms the slide closure panel. One of the side flaps is provided with an opening formed therein.

The slide closure panel is mounted on an exterior side wall of the carton which is overlapped and glued to an interior side wall containing the side flap provided with the opening. The lowermost or interior one of the pair of overlapped side flaps rests on the opposite side flap and supports the uppermost or exterior side flap which forms the slidable closure panel.

A front and back top closure wall flap is then folded over the side slide panel and adhesively secured together along overlapped edges thereof in normal sequence. Each of the top closure walls include an opening which is registered with the other and both of which can be placed in registration with the opening in the lowermost one of the overlapped side flaps when the side slide closure panel is slid laterally with respect thereto. When the openings are placed in registration, one or more articles can be dispensed from the interior of the container.

BRIEF DESCRIPTION OF THE DRAWINGS

Further objects and advantages of the invention will become apparent from the following description and claims, and from the accompanying drawings, wherein:

FIG. 1 is a plan view of a blank for forming a prior art slide top dispensing carton;

FIG. 2 is a front perspective view of the prior art carton formed from the blank of FIG. 1 with the top closure open prior to folding;

FIG. 3 is a view similar to FIG. 2 but illustrating the folding sequence of the flaps forming the top closure of the carton;

FIG. 4 is a view similar to FIG. 3 but illustrating the assembled top wall closure and the use of the slide closure panel;

DETAILED DESCRIPTION OF THE PREFERRED EMBODIMENT

Figure 5:
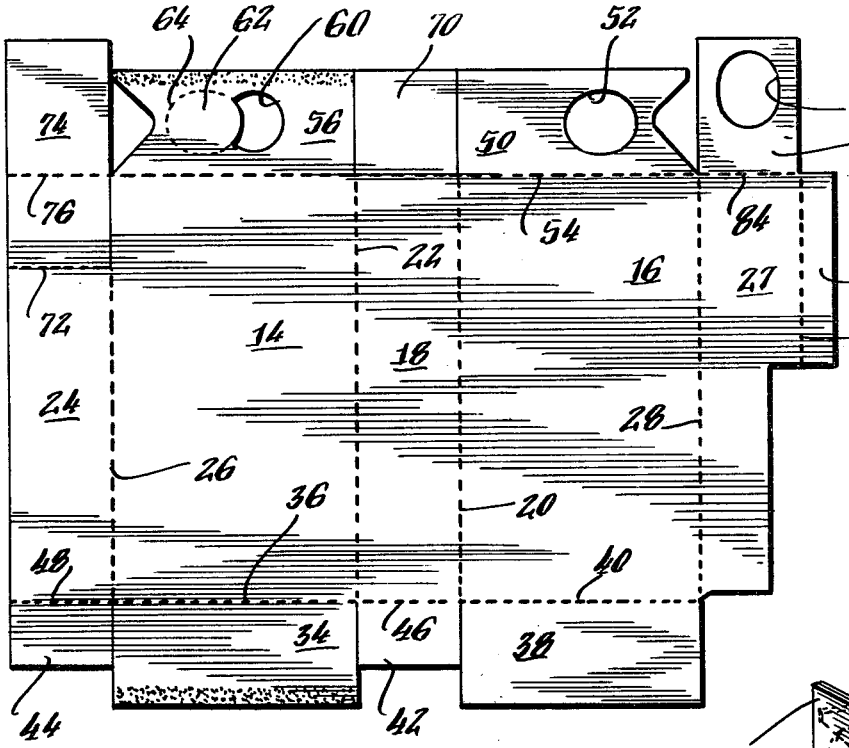
FIG. 5 is a plan view of a blank for forming the slide top dispensing carton of the present invention.

Referring now to the drawings in detail wherein like numerals indicate like elements throughout the several views, the blank 10 illustrated in FIG. 1 is used to form a slide top closure carton 12, which is standard in the art. Blank 10 includes a main front panel 14, a main rear panel 16, and a side panel 18 which connects the front and rear panels by vertical score lines 20 and 22. Panels 14, 16 and 18 are substantially rectangular in shape. A second side panel 24 is connected by a vertical score line 26 to the left-hand side edge of front panel 14.

Panel 24 overlaps a third side panel 27 connected to the righthand side edge of rear panel 16 by a vertical score line 28 as shown in FIG. 2 when blank 10 is folded about vertical score lines 20, 22, 26 and 28. Side panel 24 comprises an outer side panel and side panel 27 an inner side panel when the two side panels are overlapped and the blank 10 folded into a substantially rectangular parallelopiped configuration as indicated in FIGS. 2 to 4. Connected by a perforated hinge line 30 to the vertical free edge of side panel 27 is a side panel extension flap 32. Extension flap 32 is bent about hinge 30 and placed in abutment with the interior of the front panel 14 along score line 26 before side flap 24 is glued in overlapping relation to side panel 27, to space the front and rear panels.

Extending from the bottom edge of the front panel 14 is a bottom closure panel 34 connected to the bottom edge of front panel 14 by a horizontal score line 36. A similar rear bottom closure panel 38 is connected to the bottom edge of the rear panel 16 by a horizontal score line 40. Side flaps 42 and 44 are connected to the bottom of side panels 18 and 24, respectively, by horizontal score lines 46 and 48, respectively. Conventional folding machinery causes the side flaps 42 and 44 to be folded first about score lines 42 and 44, respectively, after which flaps 38 and 34 are overlapped and glued together to form the bottom closure of carton 12.

Connected to the top edge of rear panel 16 is a top closure flap 50. Flap 50 includes a central opening 52 and is hingedly connected to the top edge of rear panel by a score line 54. A top closure flap 56 is also hingedly connected along a score line 58 to the top edge of the front panel 14. An opening 60 of substantially the same size as opening 52 is formed in the middle of panel 56. The opening is partially closed by a tab 62 connected to the side walls surrounding opening 60 by a perforated score line 64. By grasping one end of tab 62 through opening 60, the tab can be removed from the interior of the opening 60 by breaking perforated line 64. Top closure panel 56 includes an extension flap 66 connected to the top edge thereof by a score line 68.

Connected by a horizontal score line 69 to the top edge of side panel 18 is a side flap 70. Connected to the top edge of said panel 24 by a score line 72 is a slide closure 74 which includes a horizontal score line 76 intermediate the ends thereof colinear with score line 58.

The folding sequence of the top closure is unorthodox and requires an adjustment of the standard folding machine.

To form the top closure of carton 12 with a slidable closure, rather than first folding the two side flaps 70 and 74, the side flap 70 is first folded about score line 69 then top closure flap 50 is folded over flap 70 about hinge line 54 to form a support or base for the slide closure panel 74, which is then folded about hinge line 76 on top of closure panel 50 as shown in FIGS. 2 and 3.

The side panel 24 is adhesively connected to the outer surface of side panel 27 up to hinge line 72, enabling the slidable closure panel 74 to move laterally across the top of top closure flap 50 so as to alternately open and close opening 52. The slidable closure panel 74 can pivot about hinge line 72 to enable it to be moved across the top of top closure flap 50.

In order to complete the folding sequence and the carton construction, top closure flap 56 is then pivoted about score line 58 to seat on top of the slidable closure panel 74 as shown in FIG. 4. The extension panel 66 is then bent 90° about score line 68 and adhesively connected to the outer surface of rear panel 16. Because slidable closure panel 74 is disposed between flaps 50 and 56, the flaps cannot be adhesively connected to each other. This necessitates the use of the extension flap 66 resulting in the requirement of additional material for the blank as well as being uneconomical in laying out the blank on a paperboard pattern, resulting in the uneconomical waste of material from the pattern.

With the slidable closure 74 moved laterally to expose opening 52, as indicated in phantom in FIG. 4, the opening 52 will be in registration with the opening 60 (once tab 62 is removed) so that articles can be dispensed from the interior of the carton through the top closure of carton 12.

Referring now specifically to the remaining FIGURES of the drawings, and particularly FIG. 5, the blank of the improved slide top closure carton ofthe present invention is disclosed and is generally designated by the numeral 80.

Figure 11:
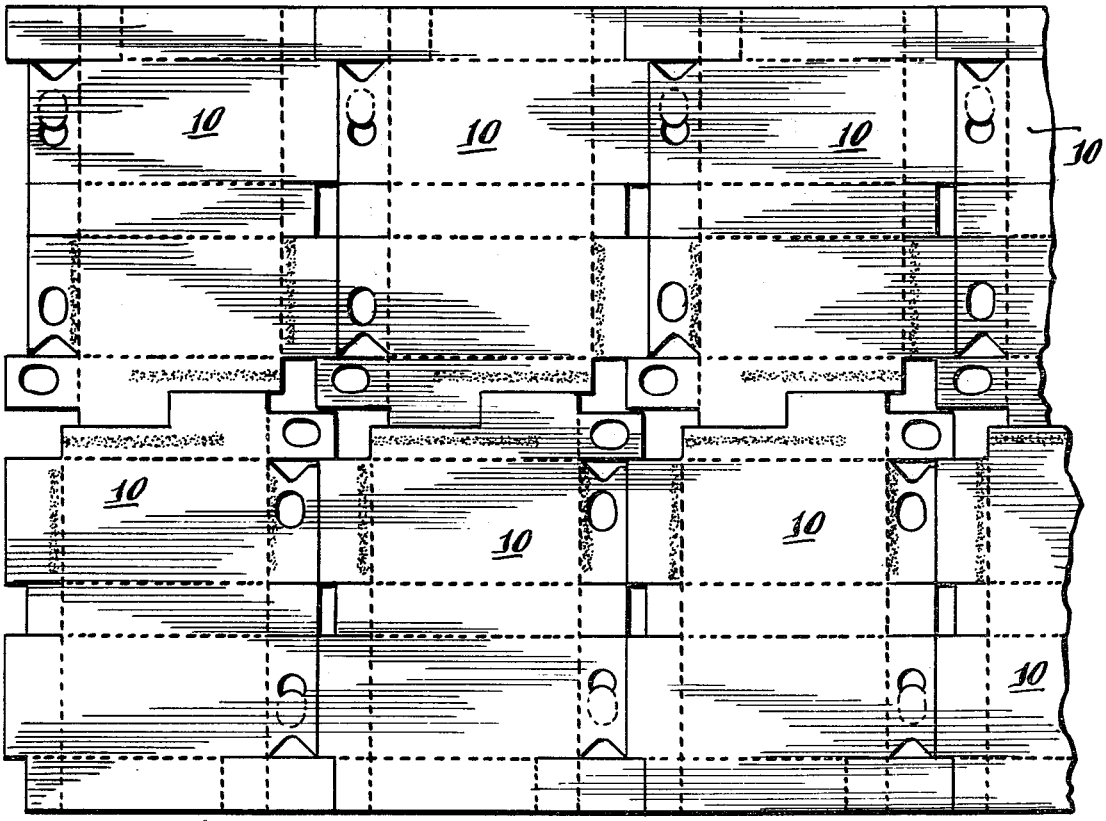
FIG. 11 is a top plan view illustrating the manner in which the blank of FIG. 5 is cut from a standard width sheet of paperboard.

The blank 80 is substantially identical in all respects with the blank 10 except for two significant changes. First, an upper side flap 82 is connected by a score line 84 to side panel 27. Flap 82 includes an opening 86 formed therein which is of the exact shape as openings 54 and 60 in the panels 50 and 56, respectively. Second, the extension flap 66 on the top closure panel 56 is eliminated from the new blank construction 80. As will be explained hereinafter, there is simply no need for the extension panel. This results in a significant savings of material and enables the blank 80 to be nested in two directions when laid out on a paperboard pattern as indicated in FIG. 11, thereby taking advantage of economical use of the paperboard pattern and providing less waste than possible heretofore. In all other respects, blank 80 is substantially identical to blank 10 and the identical numerals on blank 80 are provided to indicate identical elements.

By virtue of the provision of the side flap 82, the blank 10 can be folded in standard sequence by a conventional folder. As before, the blank is first folded along vertical score lines 26, 22, 20, 28 and 30 to form a rectangular parallelopiped carton 12'. The bottom closure is formed as before by first folding side flaps 42 and 44 about hinge lines 46 and 48, respectively, and then folding flaps 38 and 34 connected to the rear and front wall panels 16 and 14, respectively, about hinge lines 40 and 36, respectively, into overlapping relation and adhesively connecting these panels. The extension panel 32 is then placed in abutment with the interior surface of the front wall panel 14. Side panel 24 overlaps side panel 27 and is glued thereto up to hinge line 72 to form a two-ply side wall.

Figure 6:
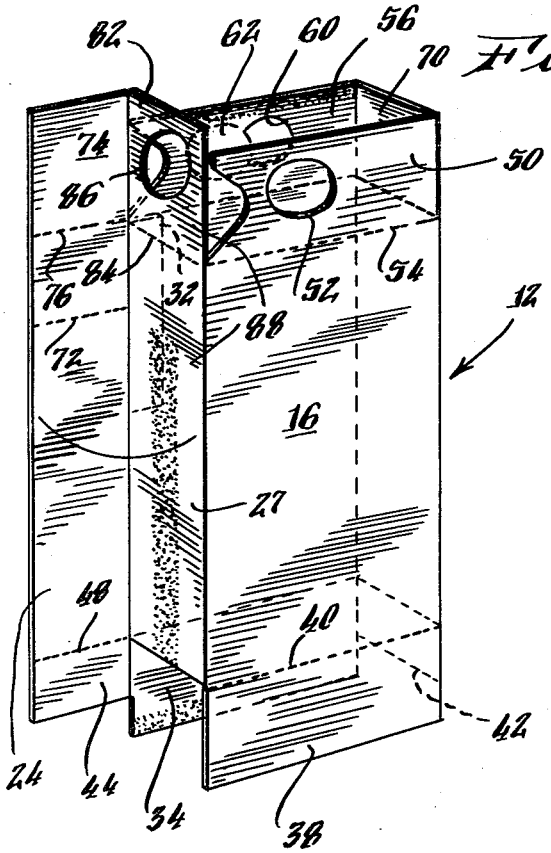
FIGS. 6 to 9, inclusive, are front perspective views illustrating the folding of the blank of FIG. 5 to form the carton of the present invention.
Figure 7:
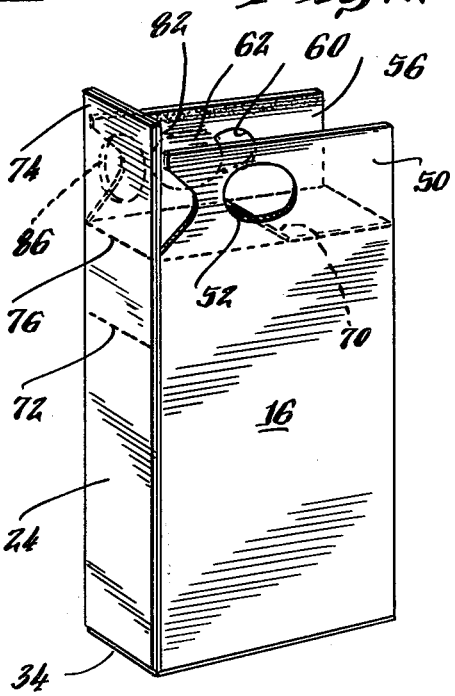
Figure 8:
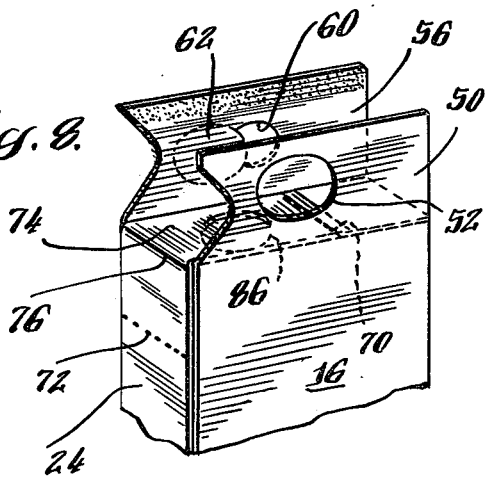
Figure 9:
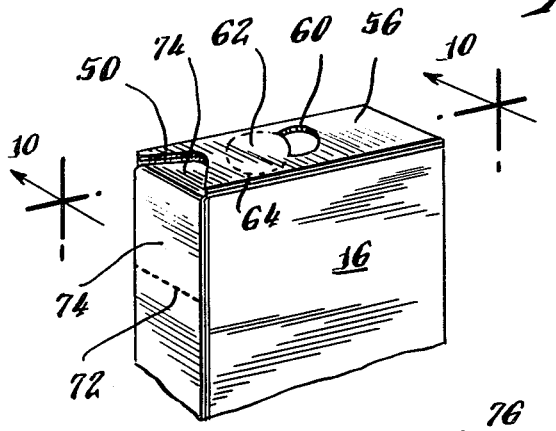

It will be seen that when this construction has been accomplished, slide panel 74 overlies the side panel 82 connected to the top of side wall 27 by score line 84 (see FIGS. 6 and 7). By virtue of this arrangement, side flap 70 and its underlying side flap 82 can then be folded so that side flap 82 rests on top of side flap 70 (FIG. 8). Side flap 82 provides a base or support for the side flap 74 or slidable closure panel so that it will not fall down into the interior of the carton. The next step in the standard folding sequence will be to overlap panels 50 and 56 so as to bring openings 52 and 64 into registration on the top closure of the carton (FIG. 9). Since in the improved construction, the flaps 50 and 56 can be overlapped without the slide closure panel therebetween, flap 56 can be glued directly to flap 50, thereby eliminating the necessity of the extension flap 66 in the prior art construction of FIGS. 1 to 4.

Figure 10:
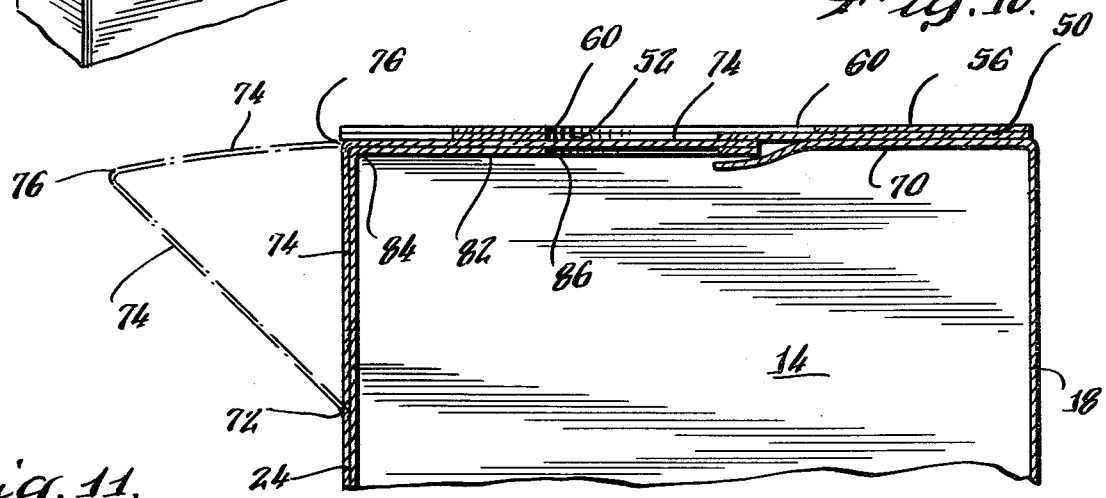
FIG. 10 is a cross-sectional view taken substantially along the plane indicated by line 10—10 of FIG. 9.

When the slide closure panel 74 is moved laterally with respect to the panels 50 and 56, the registered openings 52 and 60 in the flaps 50 and 56, respectively, will be in registration with the opening 86 in the side flap 82, thereby enabling the contents of the carton to be dispensed through the aligned openings 86, 52 and 60, which are then placed in registration, as shown in FIG. 10.

A heavily varnished area 88 may be provided on a portion of the outer surface of side flap 27 and its side flap 82. The varnished area 88 is essential for gluing of the carton, if the carton is to be glued on a straight line gluer. This precludes gluing of the slide panel 74 to the side flap 82 and the top of the side panel 27 so that the slide closure panel 74 can freely move laterally of the panels 50 and 56. Alternatively, the carton can be produced without the varnished area 88 and the glue applied by spotting the requisite areas.

What is claimed is:

1. A slide top closure dispensing carton comprising:

a front wall, a rear wall, and a pair of opposed side walls connecting said front wall to said rear wall, one of said side walls including a two-ply construction, and a top closure including a flap hingedly connected to the other of said side walls, a flap hingedly connected to each ply of said one of said side walls and disposed in overlapping relation, the innermost one of said side wall flaps of said two-ply side wall construction including an opening therethrough and being adapted to overly and rest upon the other of said side wall flaps, the outermost flap of said two-ply side wall construction being hingedly connected to said side wall for movement towards and away from said side wall and said innermost one of said flaps of said two-ply wall construction, said outermost one of said flaps of said two-ply wall construction being bent about a score line to rest upon the innermost one of said flap extensions of said two-ply side wall construction to overly and close the opening formed therethrough, and a top closure flap hingedly connected to said front and rear walls, each of said top closure flaps including an opening therethrough adapted to be placed in registration with each other when said flaps are overlapped on top of said carton, said top closure flaps being adhesively secured together, and the outermost side flap of said two-ply side wall being slidable relative to said overlapped and secured top closure flaps so as to enable the opening in the innermost one of said side wall flap extensions to be brought into registration with the registered openings in said top wall closure flaps.

2. The carton of claim 1 wherein the innermost side wall ply of said two-ply side wall construction includes an upper side flap in abutment with the front wall of said carton.

3. The carton of claim 1 including a removable tab connected by lines of separation to the edge of the opening in one of said top closure flaps.

4. A blank for forming a slide top dispenser carton comprising:

a first and second rectangular wall panel connected by an intermediate rectangular wall panel, a side panel connected by a vertical score line to a side edge of each of said first and second rectangular panels, a substantially rectangular flap connected by a horizontal score line to each of said first, second, intermediate and side panels, an opening in said flaps connected to said first and second rectangular panels, an opening in said flap connected to one of said side panels, and the other of said flaps connected to the other of said side panels being hingedly connected to the top edge of said side panel and including an horizontal score line enabling said side panel to be folded intermediate the ends thereof.

* * * * *